US007040695B2

(12) United States Patent
McClure

(10) Patent No.: US 7,040,695 B2
(45) Date of Patent: May 9, 2006

(54) BENCH CABINET FOR CHANGING SHOES

(76) Inventor: J. William McClure, P.O. Box 647, East Sound, WA (US) 98245

( * ) Notice: Subject to any disclaimer, the term of this patent is extended or adjusted under 35 U.S.C. 154(b) by 0 days.

(21) Appl. No.: 10/794,902

(22) Filed: Mar. 8, 2004

(65) Prior Publication Data

US 2005/0194824 A1 Sep. 8, 2005

(51) Int. Cl.
*A47C 7/62* (2006.01)
*A47B 83/00* (2006.01)

(52) U.S. Cl. ..... 297/188.08; 297/188.03; 312/235.9

(58) Field of Classification Search ..... 297/188.08, 297/188.03, 188.01, 188.07, 217.1, 411.43; 312/235.2, 235.5, 235.9, 235.6
See application file for complete search history.

(56) References Cited

U.S. PATENT DOCUMENTS 797,826 A * 8/1905 Sherman, Jr. ..... 312/235.2
843,547 A * 2/1907 McKensey ..... 5/50
1,265,977 A * 5/1918 Vordermark ..... 312/235.2
1,327,941 A * 1/1920 Camp ..... 5/58
1,341,596 A * 5/1920 Shaw ..... 312/235.2
1,447,145 A * 2/1923 Morell ..... 312/235.2
3,353,865 A * 11/1967 Bass ..... 297/143
5,378,044 A * 1/1995 Rhodes ..... 297/423.25

FOREIGN PATENT DOCUMENTS

JP 410033276 * 2/1998

* cited by examiner

*Primary Examiner*—Milton Nelson, Jr.
(74) *Attorney, Agent, or Firm*—Charles C. McCloskey

(57) ABSTRACT

A piece of furniture for changing shoes has pairs of slippers, a bench, and a cabinet. The bench has a seat and a shoe display or shelf beneath. A front leg, an armrest, and a rear leg assist guests at the end of a bench. A backrest spans from the rear leg to the cabinet. Opposite the front leg, a cabinet stores slippers in compartments behind doors. Alternatively, the furniture has two benches and the backrest omitted. Upon entering a house, a guest sits upon the bench, removes his shoes, places them upon the shelf, and puts on slippers from the cabinet. To leave, a guest places soiled slippers in a drawer inside the cabinet, dons their shoes, and returns to the street. Later, a homeowner retrieves the soiled slippers, cleans them, and returns them to the compartment for use by their next guests.

4 Claims, 4 Drawing Sheets

BENCH CABINET FOR CHANGING SHOES

BACKGROUND OF THE INVENTION

The present invention relates to a Bench Cabinet for Changing Shoes for use as furniture near an entrance to a home. The Bench Cabinet for Changing Shoes has particular utility in storing footwear beneath a seat and in providing slippers for houseguests to wear indoors.

Bench Cabinets for Changing Shoes are desirable for assisting guests in changing from street shoes to slippers. In the Orient, Europe, and Polynesia and in certain religious sects, guests remove their shoes upon entering a house. Shoe removal honors the owner, follows custom, and promotes cleanliness. The shoe removal custom has gained in popularity in America, starting in upper class homes. Typically, guests enter a home, remove their shoes and walk around only wearing their socks. In some cases, slippers are available for guests. The slippers put guests in a more relaxed state of mind and separate the home from the outside world. Slippers also protect the floors and contents of a home from wear and tear. At times, shoes and slippers accumulate in unsightly piles and guests require assistance in removing and donning footwear. Upon departure, guests remove the slippers, don their shoes, and return to the street.

DESCRIPTION OF THE PRIOR ART

The use of a bench cabinet is known in the prior art. For example, U.S. Pat. No. 4,165,124 to Olan describes a chair with storage cabinets on each side and a footrest in front. This combination chair has an upholstered seat, footrest, and two cabinets. Further, this patent discloses cabinets next to a chair to assist in changing shoes. Meanwhile, the present invention has a plain seat and a single cabinet.

Similarly, U.S. patent application Ser. No. 2002/0060491 to Kneier describes a chair with a storage bin beneath forming a footrest akin to a step. This chair has a footrest beneath and in front of the seat. The present invention has a bench with one cabinet to the side and an open shoe rack beneath the bench.

Similarly, U.S. Pat. No. 6,086,171 to Ashley et al. shows a cabinet for storing and retrieving shoes without a seat. The cabinet has spokes from a hub between two rings and lacks a bench. The present invention lacks a carousel storage system.

Similarly, U.S. Pat. No. 3,563,390 to Kim shows another cabinet for storing shoes with doors and rails for a shoe rack. The cabinet describes storing shoes—toes up—on racks that pull out of the cabinet behind doors with shoe pockets. The present invention stores shoes generally flat on fixed rungs or a sheet beneath the seat.

Similarly, U.S. Pat. No. 5,104,208 to Gesing represents a cabinet with two compartments for storing shoes vertically then displaying shoes horizontally when pulled down. The present invention lacks pull down compartments and has a bench.

Similarly, U.S. Pat. No. 3,888,353 to Leifheit illustrates cross ties formed into a rack to store shoes. The cross ties span between stackable supports. The present invention has a vague resemblance to cross ties in the rungs as the display means but also has a cabinet and bench unlike Leifheit '353.

Similarly, U.S. Pat. Nos. D398,787 & D403,880 to Malik illustrate a rack for storing shoes similar to Leifheit's patent above. These racks have rails between rectangular supports with connecting points forming a stackable assembly. Lacking a bench and a cabinet, these racks substantially differ from the present invention.

Similarly, U.S. Pat. No. 6,145,931 to Subotic shows a retractable footrest within a stool. The footrest has a cammed extending arm and a pull out tray. The present invention lacks an extending arm and adds a cabinet in contrast to Subotic's invention.

Similarly, U.S. Pat. No. 1,505,829 to Warnecke shows a dressing chair with a pull out footrest with a coat hanger shaped back, trouser rollers, and no cabinet. The present invention omits a footrest while including a cabinet.

Similarly, U.S. Pat. No. 2,607,946 to Price et al. shows an unusual shape for a stool with another pull out footrest and an upholstered seat. This stool lacks a backrest and a side cabinet while using conic sections to form the seat.

Similarly, U.S. Pat. No. 1,447,145 to Morell et al. shows a seat atop a portable case for shoes with hinged panels. This case lacks a cabinet beside the seat while having casters for movement. The present invention has a cabinet adjacent to a seat and a fixed location.

Lastly, One Way Furniture Inc. sells a gossip bench on their website. Most likely, gossip benches appeared shortly after the invention of the telephone. In simplest form, a gossip bench has a small table on one end upon which rests a telephone and a shelf within the table for a telephone book. In a more complex form, the bench has a pull up seat with an enclosed storage box and side mounted magazine rack. Adjacent to the bench, an integral chest of drawers provides additional storage. In contrast, the present invention has a fixed seat that accommodates at least two people, open storage for shoes upon racks beneath the seat, and compartments with a drawer designed for slippers behind a door.

While the above-described devices fulfill their respective, particular objectives and requirements, the aforementioned patents and website do not describe a Bench Cabinet for Changing Shoes that stores footwear beneath a seat and provides a cabinet with slippers to wear while indoors. The Olan '124 and Subotic '931 patents and Kneier '491 patent application make no provision for a single cabinet adjacent to a seat. The Ashley et al '171 patent does not store shoes in fixed compartments within a cabinet. While the Kim '390 patent does not store shoes flat on a stationary platform. The Gesing '208 patent omits fixed horizontal compartments and a bench. The Leifheit '353 patent describes rungs but makes no provision for a bench or cabinet. The Malik D '787 & D '880 design patents show racks without permanent attachment to a bench. The Warnecke '829 patent makes no provision for a cabinet. The Price et al. '946 patented stool and Moore et al. '145 patented seat case also lack an adjacent cabinet and slippers. Further, the present invention differs from the One Way Furniture Inc. gossip bench by open storage beneath the seat, a cabinet with compartments for slippers of various sizes, a door concealing the compartments, and a drawer for used slippers.

Therefore, a need exists for a new and improved Bench Cabinet for Changing Shoes that can be used for providing slippers to guests and for storing their shoes. In this regard, the present invention substantially fulfills this need. In this respect, the Bench Cabinet for Changing Shoes according to the present invention substantially departs from the conventional concepts and designs of the prior art, and in doing so provides a device primarily developed for the purpose of assisting guests in removing street shoes and donning slippers when a homeowner requests that of guests upon their entering a home.

SUMMARY OF THE INVENTION

In view of the foregoing disadvantages inherent in the known types of shoe storing cabinets now present in the prior art, the present invention provides an improved Bench Cabinet for Changing Shoes, and overcomes the above-mentioned disadvantages and drawbacks of the prior art. As such, the general purpose of the present invention, which will be described subsequently in greater detail, is to provide a new and improved Bench Cabinet for Changing Shoes and method which has all the advantages of the prior art mentioned heretofore and many novel features that result in a Bench Cabinet for Changing Shoes which is not anticipated, rendered obvious, suggested, or even implied by the prior art, either alone or in any combination thereof.

To attain this, the present invention essentially comprises a wooden piece of furniture for changing shoes that has pairs of slippers, a bench, and a cabinet with compartments and a drawer. The slippers have a variety of sizes for use by guests. The bench has a seat and shoe display means under the seat. A front leg, armrest, and rear leg assist guests at the end of a bench. A backrest spans from the rear leg to the cabinet. At the end of a bench opposite the front leg, a cabinet stores slippers behind doors. As an alternate form, the present invention has a cabinet with one bench flanking on each side. The cabinet contains slippers of various sizes for houseguests to wear while indoors. Slots in the cabinet separate the slippers by size. The cabinet also has a drawer to accept soiled slippers after use. The home owner later retrieves the soiled slippers, cleans them, and returns them to the proper slots. There has thus been outlined, rather broadly, the more important features of the invention in order that the detailed description thereof that follows may be better understood and in order that the present contribution to the art may be better appreciated.

The piece of furniture may include display means formed by rungs running lengthwise under the seat or by a planar sheet. The cabinet stores slippers in compartments with a drawer for collecting used slippers for cleaning. Alternatively, the piece of furniture lacks a backrest for an open back design. Additional features of the invention will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. The present invention may have a few designs upon a regional or national theme, for example: an Asian version, a European version, a modern American version or an early American version. Regardless of furniture theme, the present invention retains certain practical features: a bench, storage below the bench, and a cabinet with compartments, a drawer, and a door. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and devices for carrying out the several purposes of the present invention. It is important, therefore, that the claims be regarded as including such equivalent constructions insofar as they do not depart from the spirit and the scope of the present invention.

It is therefore an object of the present invention to provide a new and improved Bench Cabinet for Changing Shoes that has all of the advantages of the prior art bench cabinets and none of the disadvantages.

It is another object of the present invention to provide a new and improved Bench Cabinet for Changing Shoes that may be easily and efficiently manufactured and marketed.

Even still another object of the present invention is to provide a Bench Cabinet for Changing Shoes for assisting guests in changing shoes. This allows ready removal of shoes by seated guests and donning of slippers.

Still yet another object of the present invention is to provide a Bench Cabinet for Changing Shoes for assisting guests in changing shoes. This makes it possible to store guests' shoes neatly beneath a seat.

Still yet another object of the present invention is to provide a Bench Cabinet for Changing Shoes for assisting guests in changing shoes. This makes it possible to reduce tracking of debris from the street through a house.

Lastly, it is an object of the present invention to provide slippers and to collect slippers for cleaning in a central location.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
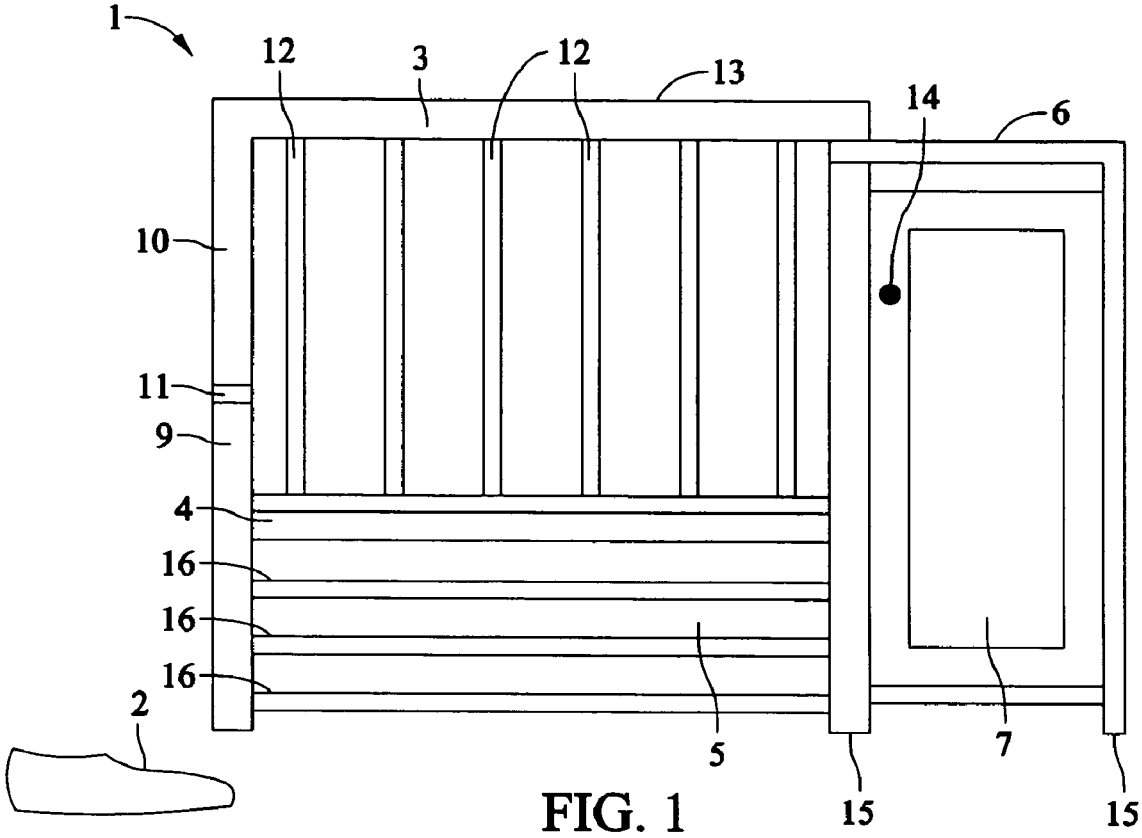
FIG. 1 is a front elevation view of the preferred embodiment of the Bench Cabinet for Changing Shoes constructed in accordance with the principles of the present invention.

Referring now to the drawings, and particularly to FIGS. 1–7, a preferred embodiment of the Bench Cabinet for Changing Shoes of the present invention is shown and generally designated by the reference numeral 1.

In FIG. 1, a new and improved Bench Cabinet for Changing Shoes 1 of the present invention for assisting guests in removing and storing shoes is illustrated and will be described. The wooden bench 3 of the present invention 1 begins with a seat 4, generally rectangular with the length of the seat 4 coaxial with the length of the present invention 1 and having two opposite ends and four corners. Upon one end and one corner, the seat 4 has a front leg 9 depending from the seat 4. The front leg 9 joins the seat 4 generally midway along the length of the front leg 9. The front leg 9 extends above the seat 4 and joins an armrest 11. The armrest 11 is generally parallel to the lateral axis of the seat 4 and perpendicular to the front leg 9. The armrest 11 extends for the width of the seat 4 and joins the rear leg 10. Opposite the front leg 9 upon the same end of the seat 4 as the front leg 9, the rear leg 10 joins the seat 4. The rear leg 10 is generally parallel to the front leg 9 and the seat 4 joins the rear leg 10 at the same elevation as the front leg 9. The rear leg 10 extends well above the seat 4 sufficient to support the back of a guest. The rear leg 10 serves as one end of the backrest 13.

The wooden backrest 13 is generally perpendicular to the seat 4 and has a length similar to the seat 4. Opposite the front leg 9, the backrest 13 has a plurality of parallel stiles 12 that join the seat 4. The stiles 12 extend generally vertically from the seat 4, forming the backrest 13 for guests. The backrest 13 and seat 4 then join to the cabinet 6.

The seat 4 joins the cabinet 6 on the end opposite the front leg 9 and the rear leg 10. In embodiments with a single bench 3, the bench 3 can be either to the right or the left of the cabinet 6. The wooden cabinet 6 has a generally rectangular carcass assembled by conventional cabinetry methods, a door 7 with a knob 14, and depending feet 15 beneath the carcass. The door 7 has a location upon the cabinet 6 coplanar with the front leg 9. The door 7 pivots on one vertical axis and opens away from the front leg 9. A knob 14 at a convenient height, approximately the elevation of the armrest 11, assists guests in opening and closing the door 7. Behind the door 7 as shown later in FIG. 4, the furniture has a storing means 8 for slippers 2. The slippers 2 come in pairs and have various sizes.

Beneath the seat 4, the furniture has a wooden means to display shoes 5. In the preferred embodiment, the display means 5 has the form of a rack. The rack is made of a rail 17 spanning between the front leg 9 and the rear leg 10 beneath the seat 4. Two or more rungs 16 extend from the rail 17 to the cabinet 6 carcass. The rungs 16 are generally parallel and spaced to accommodate at least children's shoes. The rack tilts at an angle to the horizontal with the rail 17 tilted and the rung 16 nearest the front leg 9 at the lowest elevation of the rungs 16. Beneath the carcass, two or more feet 15 depend to a plane coplanar with the bottom of the front leg 9 and the rear leg 10.

Figure 2:
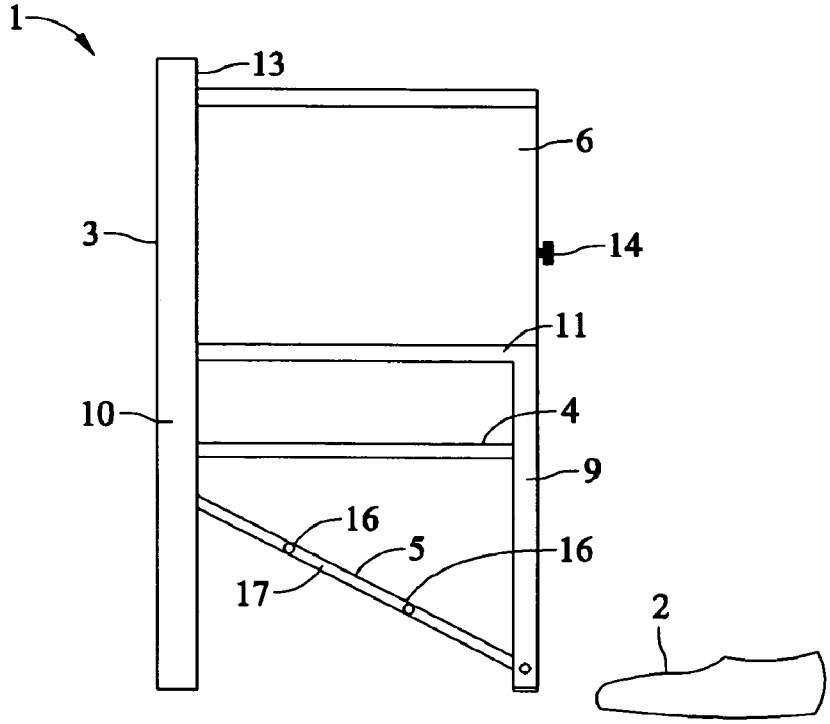
FIG. 2 is a side elevation view of the preferred embodiment of the Bench Cabinet for Changing Shoes of the present invention.

Turning to FIG. 2, an end view of the present invention 1 appears. On this end, the present invention 1 has the seat 4 with the front leg 9 perpendicular to the seat 4 and to the length of the present invention 1. The seat 4 attaches generally to the midpoint of the front leg 9. The front leg 9 extends above the seat 4. The armrest 11 extends from the front leg 9 to the rear leg 10. The rear leg 10 attaches to the seat 4 laterally opposite to the front leg 9. The rear leg 10 extends above the seat 4 and the front leg 9, and supports the backrest 13. The display means 5 has a rail 17 spanning between the front leg 9 and the rear leg 10 at an angle. The rail 17 supports the rungs 16 between the front leg 9 and rear leg 10, and the cabinet 6. The rung 16 at lowest elevation is nearest the front leg 9. The cabinet 6 carcass attaches to the seat 4 and the backrest 13 opposite the front leg 9 and the rear leg 10. As in FIG. 1, the cabinet 6 has a door 7 with a knob 14. The knob 14 is opposite the pivoting axis of the door 7, generally towards the bench 3 of the present invention 1.

Figure 3:
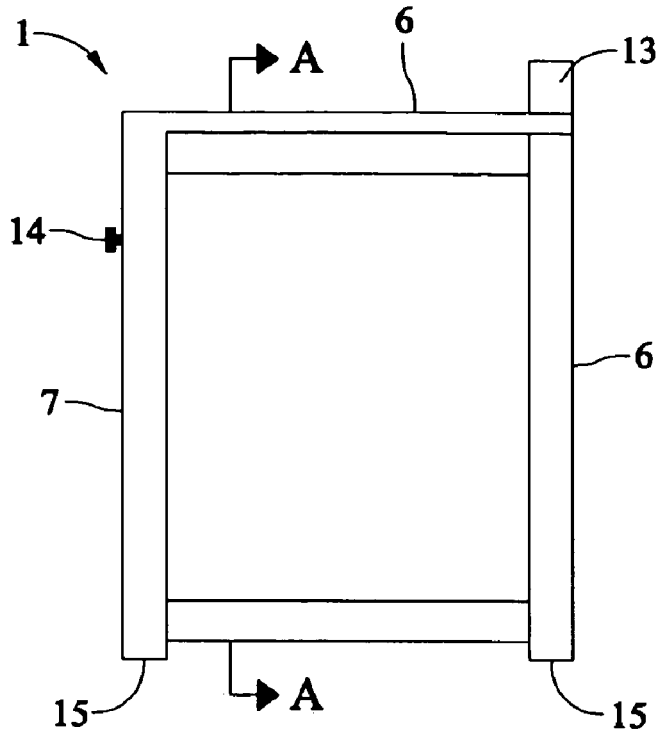
FIG. 3 is a side elevation view of the Bench Cabinet for Changing Shoes of the present invention.

FIG. 3 illustrates the opposite end of the present invention 1 than that shown in FIG. 2. The cabinet 6 has a conventionally assembled carcass, generally rectangular in shape. On this end of the present invention 1, the cabinet 6 has the pivoting axis of the door 7. Opposite the pivoting axis of the door 7, the door 7 has a knob 14 so that the door 7 opens away from the bench 3. The bench 3 attaches to the cabinet 6 at the seat 4 and the backrest 13.

Figure 4:
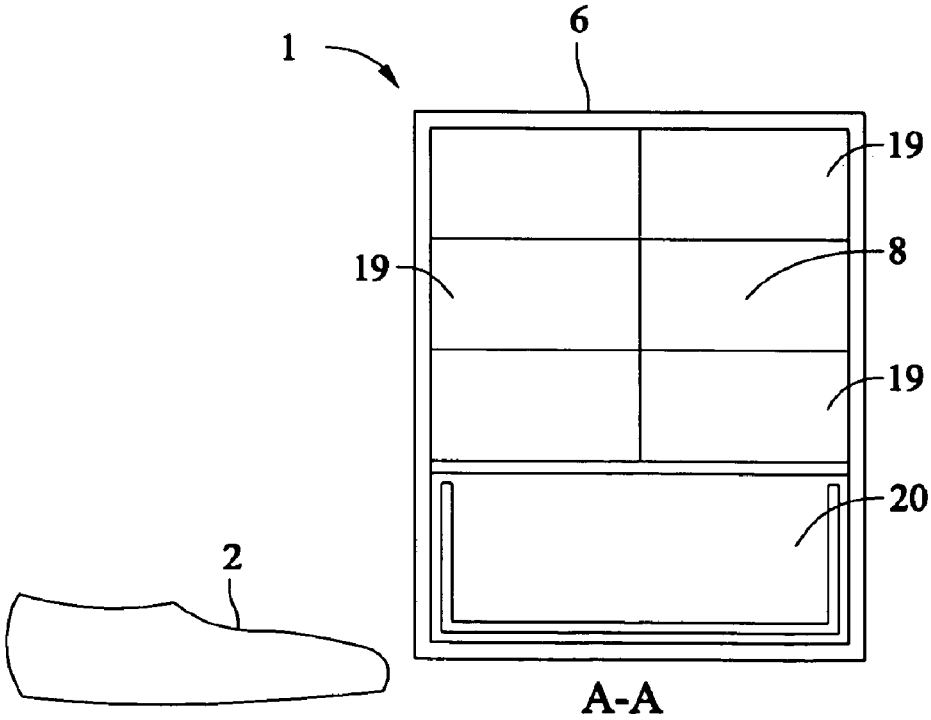
FIG. 4 is a detailed view of the storage means inside of the cabinet and behind the door of the Bench Cabinet for Changing Shoes of the present invention.

Inside the cabinet 6 and behind the door 7, the means to store 8 slippers 2 is shown in FIG. 4. The storing means 8 has two or more compartments 19 and a drawer 20. Here, the compartments 19 have a location above the drawer 20. The compartments 19 have pigeonhole form constructed by a vertical divider stile and multiple horizontal divider rails. Compartment 19 size can vary by the location of the divider stiles and divider rails. Cleaned and sized slippers 2 remain within the compartments 19 until needed by a guest. The drawer 20 has four walls and a base panel that contain used slippers 2. The drawer 20 pulls forward and out of the cabinet 6 for ease in laundering the slippers 2.

Figure 5:
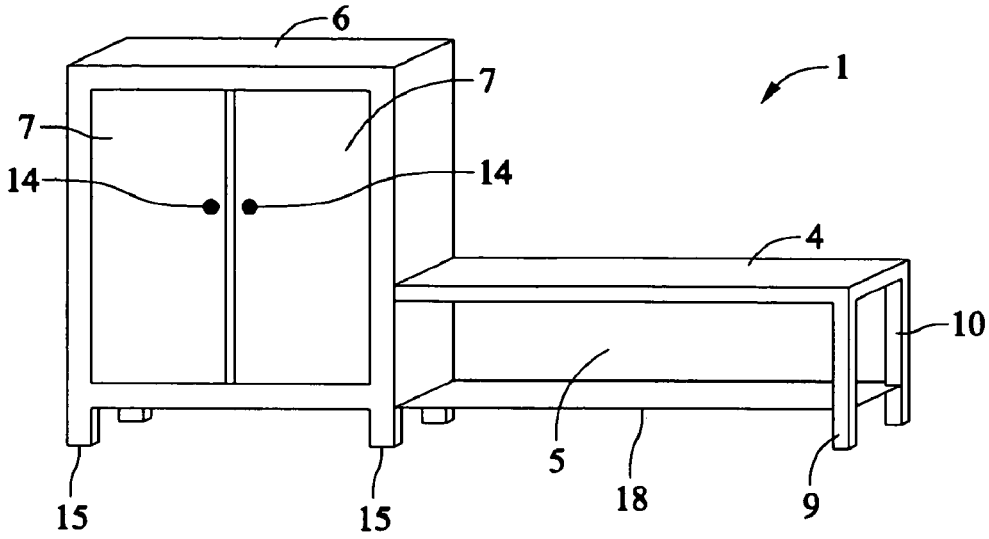
FIG. 5 is an isometric view of an alternate embodiment without backrest of the Bench Cabinet for Changing Shoes of the present invention.

FIG. 5 has an alternate embodiment of the present invention 1. The bench 3 of the present invention 1 begins with a seat 4, generally rectangular with the length of the seat 4 coaxial with the length of the present invention 1 and having two opposite ends and four corners. Upon one end and one corner, the seat 4 has a front leg 9 depending from the seat 4. The front leg 9 joins the seat 4 at the top of the front leg 9. Laterally, opposite the front leg 9, the rear leg 10 joins the seat 4. The rear leg 10 is generally parallel to the front leg 9 and the seat 4 joins the rear leg 10 at the same elevation as the front leg 9. This embodiment omits a backrest 13.

The seat 4 joins the cabinet 6 on the end opposite the front leg 9 and the rear leg 10. The cabinet 6 has a generally rectangular carcass assembled by conventional cabinetry methods, two doors 7, and depending feet 15 beneath the carcass. The doors 7 have a location upon the cabinet 6 coplanar with the front leg 9. The doors 7 pivot on parallel vertical axes and open away from the center of the cabinet 6. Behind the door 7, the furniture has a storing means 8 for slippers 2 as in FIG. 4. The slippers 2 come in pairs and have various sizes.

Beneath the seat 4, the piece of furniture 1 has a means to display shoes 5. In this alternate embodiment, the display means 5 has the form of a sheet 18. The sheet 18 spans between the front leg 9, the rear leg 10, and the cabinet 6 beneath the seat 4. The sheet 18 is generally flat, rectangular, and parallel with the seat 4. Beneath the carcass, three or more feet 15 depend to a plane coplanar with the bottom of the front leg 9 and the rear leg 10.

Figure 6:
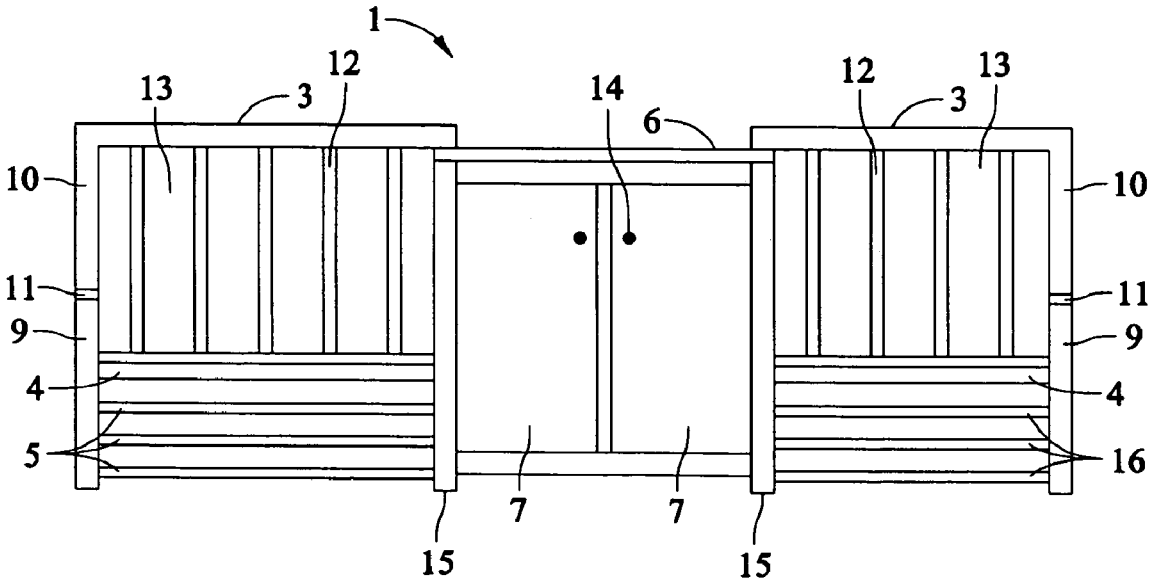
FIG. 6 is a front elevation view of an alternate embodiment with dual benches of the Bench Cabinet for Changing Shoes of the present invention; and, FIG. 7 is an isometric view of an alternate embodiment with dual benches and without backrests of the Bench Cabinet for Changing Shoes of the present invention.

FIG. 6 has a still further embodiment of the present invention 1. Beginning with a centered cabinet 6, the cabinet 6 has a generally rectangular carcass assembled by conventional cabinetry methods, two doors 7 with knobs 14, and depending feet 15 beneath the carcass. The doors 7 have a location upon the cabinet 6 and define the front of the invention 1. The doors 7 pivot on parallel vertical axes and open away from the center of the cabinet 6. Knobs 14 assist the guests in opening the doors 7. Behind the doors 7, the present invention 1 has a storing means 8 for slippers 2 as in FIG. 4. The slippers 2 come in pairs of various sizes.

Flanking the cabinet 6, seats 4 have a generally rectangular shape with the length of the seats 4 coaxial with the length of the piece of furniture 1 and having two opposite ends and four corners. Upon one end and one corner, each seat 4 has a front leg 9 depending from the seat 4. The front leg 9 joins the seat 4 generally midway along the length of the front leg 9. The front leg 9 extends above the seat 4 and joins an armrest 11. The armrest 11 is generally parallel to the lateral axis of the seat 4 and perpendicular to the front leg 9. The armrest 11 extends for the width of the seat 4 and joins the rear leg 10. Opposite the front leg 9 upon the same end of the seat 4 as the front leg 9, the rear leg 10 joins the seat 4. The rear leg 10 is generally parallel to the front leg 9 and the seat 4 joins the rear leg 10 at the same elevation as the front leg 9. The rear leg 10 extends well above the seat 4 sufficient to support the back of a guest. The rear leg 10 serves as one end of the backrest 13.

The backrests 13 are generally perpendicular to the seats 4 and have a length similar to the seats 4. Each backrest 13 has a plurality of parallel stiles 12 that join the seat 4. The stiles 12 extend generally vertically from the seat 4, forming the backrest 13 for guests. Each backrest 13 and each seat 4 then join to opposite sides of the cabinet 6 perpendicular to the doors 7. In an alternate embodiment of the present invention 1 in the "Mission theme" of the southwestern United States, the stiles 12 extend from the backrest 13 partially towards the seat 4.

Beneath each seat 4, the present invention 1 has a means to display shoes 5. In this alternate embodiment, the display means 5 has the form of a rack. The rack is made of a rail 17 spanning between the front leg 9 and the rear leg 10 beneath the seat 4 previously shown in FIG. 2. Two or more rungs 16 extend from the rail 17 to the cabinet 6 carcass. The rungs 16 are generally parallel and spaced apart to accommodate at least children's shoes. The rack tilts at an angle to the horizon with the rail 17 tilted and the rung 16 nearest the front leg 9 at the lowest elevation of the rungs 16. As an alternative, the display means 5 can be in sheet 18 form as in FIG. 5.

Figure 7:
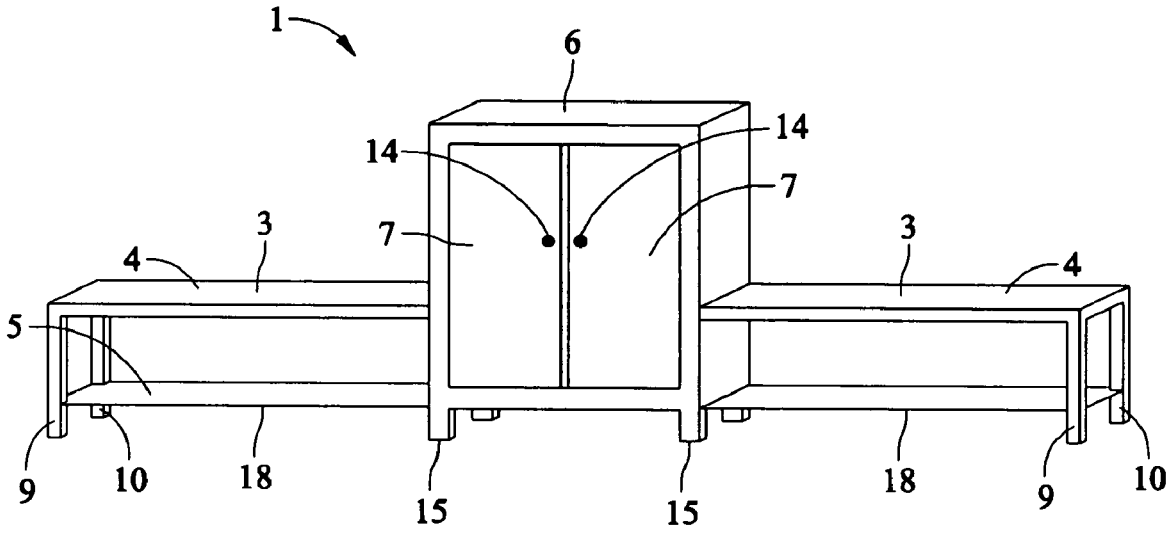

FIG. 7 has a still further embodiment of the present invention 1 having a centered cabinet 6. The cabinet 6 has a generally rectangular carcass of conventional cabinetry, two doors 7, and depending feet 15 beneath the carcass. The doors 7 have a location upon the cabinet 6 and define the front of the invention. The doors 7 pivot on parallel vertical axes and open away from the center of the cabinet 6. Behind the door 7, the furniture has a storing means 8 for slippers 2 as in FIG. 4. The slippers 2 come in pairs of many sizes.

Flanking the cabinet 6, seats 4 have a generally rectangular shape with the length of the seats 4 coaxial with the length of the piece of furniture 1 and having two opposite ends and four corners. Upon one end and one corner, each seat 4 has a front leg 9 depending from the seat 4. The front leg 9 joins the seat 4 at the top of the front leg 9. Laterally, opposite the front leg 9, the rear leg 10 joins the seat 4. The rear leg 10 is generally parallel to the front leg 9 and the seat 4 joins the rear leg 10 at the same elevation as the front leg 9. This embodiment omits a backrest 13.

Beneath the seat 4, the present invention 1 has a means to display shoes 5. In this alternate embodiment, the display means 5 has the form of a sheet 18. The sheet 18 spans between the front leg 9, the rear leg 10, and the cabinet 6 beneath the seat 4. The sheet 18 is generally flat and parallel with the seat 4. As an alternative, the display means 5 can be in rack form as in FIG. 1. Beneath the carcass, three or more feet 15 depend to a plane coplanar with the bottom of the front leg 9 and the rear leg 10.

In use, a homeowner places the Bench Cabinet for Changing Shoes 1 in an entryway or near the front door of a home. Upon a guest's arrival, the homeowner greets the guest and instructs the guest in the use of the Bench Cabinet for Changing Shoes 1. The guest sits on the seat 4 of the Bench Cabinet for Changing Shoes 1 and removes his shoes. The guest places the shoes upon the display means 5 beneath the seat 4. Opening the door 7 to the cabinet 6, the guest removes slippers 2 of the appropriate size from the compartments 19. The guest then dons the slippers 2, rises, and enters the house. At departure, the guest returns to the seat 4 and removes the slippers 2. The guest opens the door 7 and places the used slippers 2 in the drawer 20. The guest then retrieves his shoes and replaces them on his feet. After bidding farewell to the guest, the homeowner pulls the drawer 20 and cleans the slippers 2. The homeowner then returns the cleaned slippers 2 to the compartments 19 in the storing means 8.

While a preferred embodiment of the Bench Cabinet for Changing Shoes has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, metal, composite, stone, or a variety of wood may be used instead of the wooden furniture described. Although assisting guests in removing and storing shoes near the main entrance to a home has been described, it should be appreciated that the Bench Cabinet for Changing Shoes herein described is also suitable for entries at hospitals, clean rooms, restaurants, and mines. Further, the present invention can be located in a mud room or at the rear entrance to a home.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A piece of furniture for changing shoes, comprising:

a plurality of matched pairs of slippers in various sizes;

one or more benches having a seat and means for displaying shoes beneath said seat;

each of said benches having a front leg perpendicular to and adjacent to said seat, a rear leg spaced apart and parallel to and opposite said front leg, said rear leg of greater length than said front leg, an armrest joining said front leg to said rear leg above said seat, a backrest extending generally perpendicular to said seat and opposite said front leg; and, one or more cabinets laterally adjacent to said one or more benches, connecting with said backrest, and having means for storing said slippers;

each of said cabinets having a location opposite said rear leg and said front leg, one door pivotally coupled to said cabinet and coplanar with said front leg, a knob upon said door opposite where said door pivots upon said cabinet, and a plurality of depending feet supporting said cabinet.

2. The piece of furniture of claim 1 wherein said storing means is two or more compartments for clean slippers and a drawer for used slippers.

3. The piece of furniture of claim 1 wherein said display means is two or more rungs parallel to the longitudinal axis of said seat extending from a rail between said front leg and said rear leg to said cabinet upon which a guest places shoes in exchange for slippers.

4. The piece of furniture of claim 1 wherein said display means is a planar sheet spanning between said front leg, said rear leg, and said cabinet upon which a guest places shoes in exchange for slippers.

* * * * *